US005737668A

United States Patent [19]

Johroku

[11] Patent Number: 5,737,668

[45] Date of Patent: Apr. 7, 1998

[54] TONER CARTRIDGE/COLLECTING TANK ASSEMBLY

[75] Inventor: Kazuo Johroku, Osaka, Japan

[73] Assignee: Mita Industrial Co., Ltd., Osaka, Japan

[21] Appl. No.: 650,226

[22] Filed: May 20, 1996

[30] Foreign Application Priority Data

May 23, 1995 [JP] Japan ..... 7-123478
Nov. 10, 1995 [JP] Japan ..... 7-292553

[51] Int. Cl.[6] ..... G03G 15/08

[52] U.S. Cl. ..... 399/120

[58] Field of Search ..... 355/260, 296, 355/298, 270; 222/DIG. 1; 399/120, 262, 263, 360

[56] References Cited

U.S. PATENT DOCUMENTS

| | | | |
|---|---|---|---|
| 4,899,690 | 2/1990 | Hacknauer et al. | 118/653 |
| 5,078,303 | 1/1992 | Kikuchi et al. | 355/260 X |
| 5,126,799 | 6/1992 | Matsuura et al. | 355/298 |
| 5,349,425 | 9/1994 | Kamijo et al. | 355/298 |
| 5,381,217 | 1/1995 | Ishida | 355/260 |
| 5,398,098 | 3/1995 | Fukunaga et al. | 355/200 |
| 5,555,081 | 9/1996 | Hatta et al. | 355/298 |
| 5,574,549 | 11/1996 | Sundquist | 399/262 |

FOREIGN PATENT DOCUMENTS

| | | |
|---|---|---|
| 3-028862 | 2/1991 | Japan . |
| 5-216342 | 8/1993 | Japan . |

*Primary Examiner*—Robert Beatty
*Attorney, Agent, or Firm*—Shinjyu Office of Patent Attorney

[57] ABSTRACT

An image forming apparatus which facilitates replacement of a toner cartridge and collecting tank as a unit. The toner cartridge's exterior surface has an integrally formed collecting tank support portion having two opposing claws angled at an obtuse angle. The collecting tank has a support member for engaging the support portion of the toner cartridge for freely attaching/detaching the collecting tank to the toner cartridge.

40 Claims, 17 Drawing Sheets

TONER CARTRIDGE/COLLECTING TANK ASSEMBLY

BACKGROUND OF THE INVENTION

A. Field of the Invention

The present invention relates to a toner cartridge for an image forming apparatus such as an electrostatic copying machine, a facsimile device or a laser beam printer.

B. Description of Related Art

In an image forming apparatus such as a copying machine, generally an image read from a original document by an exposure unit is formed over a photosensitive drum. A charging device, a developing device, a transfer-separation device and a cleaning device, etc. are disposed surrounding the photosensitive drum.

The surface of the photosensitive drum is initially charged by the charging device, and an electrostatic latent image of the original image read by the exposure unit is formed. A toner image corresponding to the electrostatic latent image formed on the photosensitive drum by a developing device. In the transfer-separation device, the toner image on the photosensitive drum is transferred to a sheet, and after the toner image has been transferred to the sheet, it is separated from the photosensitive drum. In the cleaning device, after transferring the toner image to the sheet, toner remaining on the surface of the photosensitive drum is removed.

The developing device is provided with a toner hopper for supplying toner. The toner hoper is outfitted with a free-attach/remove toner cartridge, and toner replenishment can be carried out by replacing the toner cartridge.

The toner removed from the photosensitive drum by the cleaning device is gathered by a collecting tank. The collecting tank is attached in a suitable place within the image forming apparatus, and when it has been filled up with the collected toner, or in accordance with a predetermined use period or use frequency, either its replacement, or toner disposal, will be carried out.

In an image forming apparatus such as that mentioned above, it can be assumed under normal circumstances that when the toner cartridge is replaced, the quantity of accumulated toner in the collecting tank will have attained a certain level or volume. Consequently, when replacing the toner cartridge, it is desireable to replace the collecting tank at the same time. However, there is a problem in that the toner cartridge and the collecting tank are entirely separate bodies. Therefore there is considerable work involved in the replacement of both bodies.

SUMMARY OF THE INVENTION

It is an object of the present invention to provide a toner cartridge for an image forming apparatus which is simple to assemble and disassemble, facilitating replacement of the toner cartridge and collecting tank.

In one aspect of the present invention, a toner cartridge for an image forming apparatus includes a toner cartridge main body having on an exterior surface thereof a collecting tank support portion and a means for installing the toner cartridge main body into a developing unit of an image forming apparatus. The toner cartridge also includes a collecting tank for collecting useless toner, the collecting tank having on an exterior surface thereof a support member corresponding to and engaging the collecting tank support portion, whereby the collecting tank and the toner cartridge main body are configured to be installable and removable as a unit from the developing unit.

Preferably, the collecting tank support portion includes two opposing hooks which extend outwardly from an exterior surface of the toner cartridge main body.

Further, the two opposing hooks are inclined with respect to one another at a predetermined angle.

Further, the toner cartridge main body is formed integrally by injection molding.

In another aspect of the present invention, the support member of the collecting tank is configured to be gripped between the hooks.

Further, the support member of the collecting tank protrudes outwardly from the collecting tank and defines a pair of grooves engageable with the hooks.

Preferably, the collecting tank is formed integrally by blow molding.

In another aspect of the present invention, the toner cartridge main body is made so as to be installed to the developing unit in a predetermined direction; the support member of the collecting tank having a guide projection extending towards the predetermined direction for the installing the toner cartridge main body, and a positioning projection formed on the upward end of the predetermined direction of the support member; and the collecting tank support portion having guide members which can be engaged with the guide projection, and positioning members which can keep the positioning projection and hold the position of the collecting tank.

Preferably, the guide members are made of resilient material, extend from the side of the toner cartridge main body toward the collecting tank and having two projecting guide portions which hold the guide projection.

Preferably, the means for installing the toner cartridge main body into the developing unit of the image forming apparatus includes a fixing member formed on the toner cartridge main body which conforms to a fixing receiver formed on the developing unit.

Preferably, the means for installing the toner cartridge main body into a developing unit of an image forming apparatus further includes a rotation control part formed on an axial surface of the toner cartridge main body to facilitate rotation of the toner cartridge main body within the developing unit.

In another aspect of the present invention, the toner cartridge main body further includes an inner cylindrical member and an outer cylindrical member, the inner cylindrical member concentrically disposed within the outer cylindrical member.

Preferably, the collecting tank support portion includes two opposing hooks which extend outwardly from an axial exterior surface of the inner cylindrical member.

Preferably, the inner cylindrical member includes a shaft which extends therethrough, and the outer cylindrical member is formed with a cover having a central aperture, the shaft extending through the central aperture.

Preferably, one end of the shaft is formed with a flat surface generally parallel to a central axis of the shaft.

Preferably, the developing unit is formed with an end wall having a slot formed therein, an inner portion of the slot defining a shaft retaining portion whereby the flat surface of the shaft is engageable with the shaft retaining portion in response to installation of the toner cartridge main body into the developing unit and rotation of the inner cylindrical member.

Preferably, the collecting tank support portion includes at least one a guide portion formed on the cover of the outer cylindrical member.

Preferably, the support member on the collecting tank further includes at least one guide projection configured to engage the guide portion on the cover.

Preferably, the guide portion comprises first, second and third guide members, the second and third guide members being composed of a resilient material and which extend from the cover for engaging and holding of the guide projection and the first guide member for limiting movement of the guide projection in a radial direction relative to the toner cartridge main body.

Preferably, the collecting tank is configured to be installable and removable from the toner cartridge main body whether or not the toner cartridge main body is installed in the developing unit.

In the toner cartridge for the image forming apparatus according to the present invention, the toner cartridge and the collecting tank can be integrally mounted into the image forming apparatus by the engagement of the various components on the main body and the collecting tank. In replacing toner cartridge, the collecting tank can simultaneously be removed from the image forming apparatus. The toner cartridge and the collecting tank can be detached, and they can be recycled respectively.

The toner cartridge main body is made so as to be installed to the developing device from a radial direction relative to the toner cartridge main body. The collecting tank support means includes a guide projection extending along collecting tank which extends in the direction of movement the main body travels during installation and removal from the developing apparatus. The collecting tank support means also includes a positioning projection formed on the upward end of the guide projection. The toner cartridge main body includes a collecting tank support portion which can be engaged with the guide projection.

These and other objects, features, aspects and advantages of the present invention will become more fully apparent from the following detailed description of the present invention when taken in conjunction with the accompanying drawings, where like reference numerals denote corresponding parts throughout, in which:

BRIEF DESCRIPTION OF THE DRAWINGS

FIG. 7 is a top elevational view of a collecting tank depicted in FIG. 5;

DETAILED DESCRIPTION OF THE PREFERRED EMBODIMENTS

Figure 1:
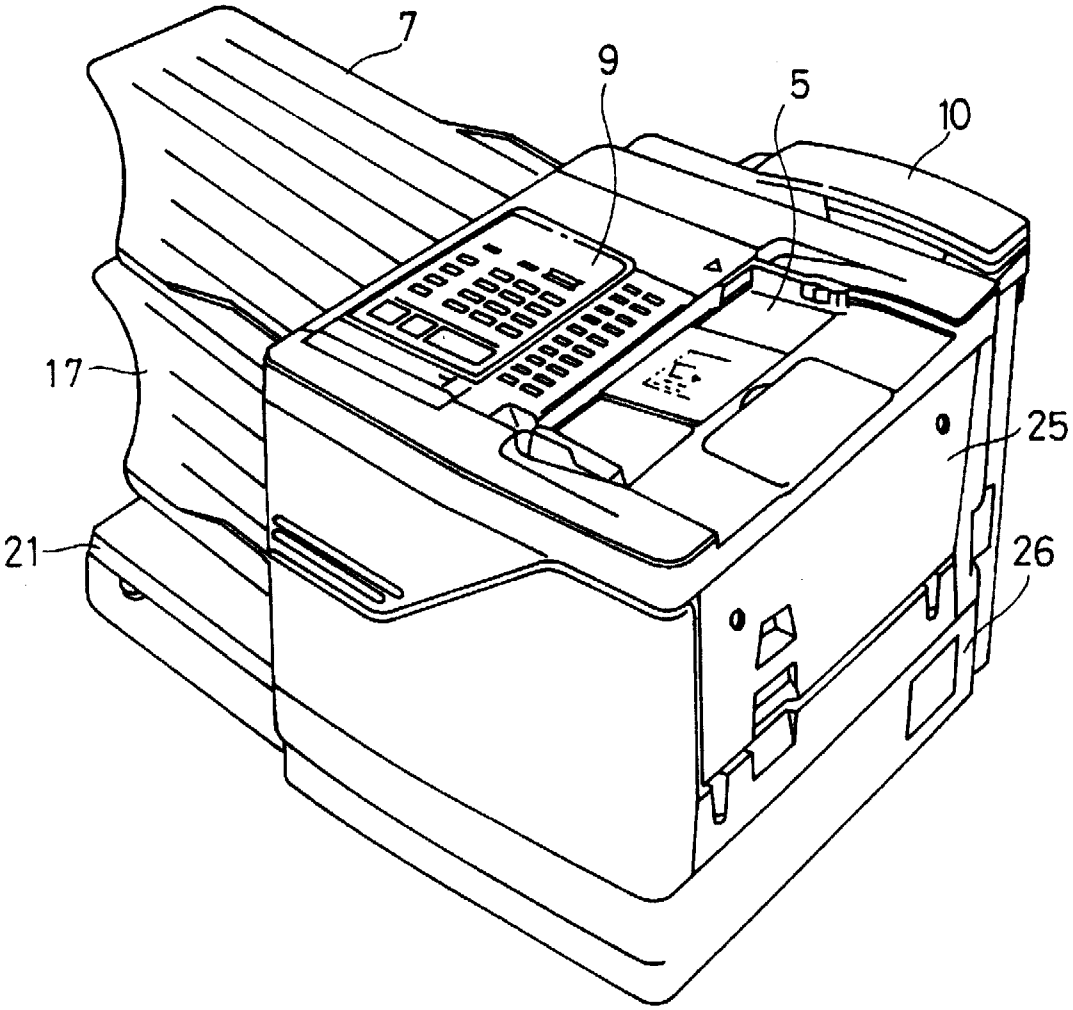
FIG. 1 is an oblique view illustrating the external appearance of a facsimile device in which an embodiment of the present invention is employed.
Figure 2:
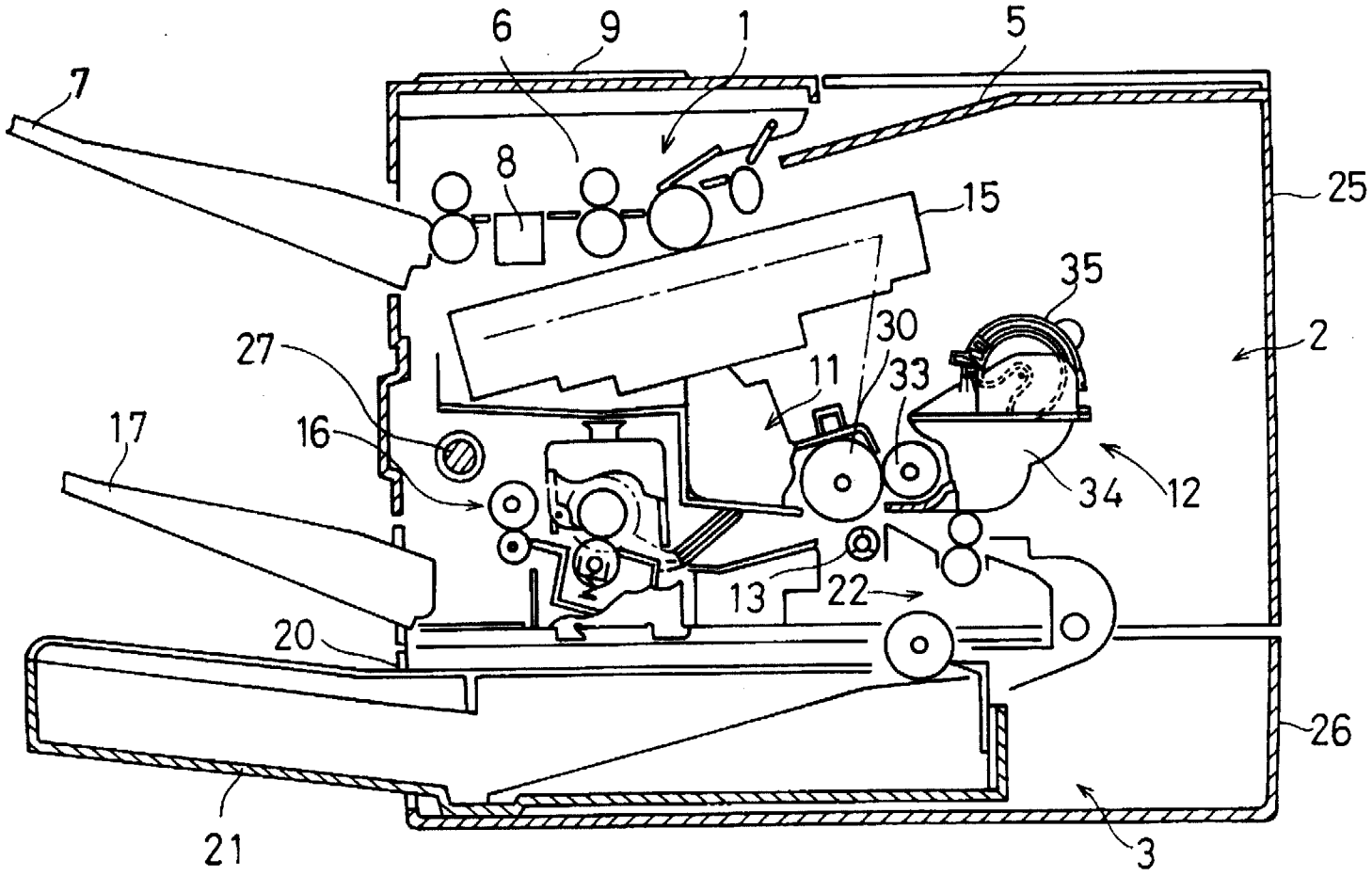
FIG. 2 is a schematic sectional view of the facsimile device depicted in FIG. 1.

The external appearance of a facsimile device incorporating the present invention in accordance with one embodiment thereof is depicted in the oblique view of FIG. 1. With reference to FIG. 1 along with the schematic sectional view in FIG. 2, the facsimile device is shown to include an image reading section 1, over which an original document from which image information to be read by the image reading section 1 is placed; an image output station 2 disposed roughly within the central portion of the device, for forming superficially onto a sheet image information received from the reading section 1, and a supply section 3 disposed in a lower portion of the device, for supplying sheets to the image output station 2.

The reading section 1 includes an original table 5 onto which original documents are positioned, an original conveyor 6 for conveying the originals, and an original document discharge tray 7 for accommodating documents discharged from the original conveyor 6. An image information reading sensor 8 for reading out image information from an original document is disposed along the original conveyor 6. A manipulating panel 9 equipped with various keys and a display is disposed on the upper surface of the facsimile device. Furthermore, in an upper portion of the facsimile device, a handset 10 is disposed.

The output station 2 includes an imaging unit 11 having a photosensitive drum 30, a developing unit 12 for developing an electrostatic latent image formed on the outer circumference of the photosensitive drum 30 with toner, a transfer roll 13 for transferring a toner image formed on the photosensitive drum 30 to a sheet, a laser device 15 for irradiating the photosensitive drum 30 to form an image corresponding to received image information, and a fixing/transport device 16 for fixing the toner image transferred onto the surface of the paper by the transfer roll 13. The paper discharge tray 17 is located in a part of the paper flow stream beyond the fixing/transport device 16.

The supply section 3 includes a sheet supply cassette 21 detachably attached to an opening 20 formed on the side of the device body, and a sheet supply device 22 for feeding sheets stored in the sheet supply cassette 21 and conveying them to the output station 2.

The facsimile device body separately consists of an upper case 25 and a lower case 26. The upper case 25 may be raised from the lower case 26 by pivoting about a hinge 27. The upper case 25 includes the reading section 1 and the imaging unit 11, the developing unit 12, and the laser device 15 of the output station 2. Disposed inside the lower case 26 are the transfer roll 13 and the fixing and transport device 16 of the output station 2, and supply section 3.

The developing unit 12 includes a magnetic-sleeve type develop roll 33, a toner hopper 34 which supports the develop roll 33, and a toner cartridge 35 installed into the toner hopper 34.

Figure 3:
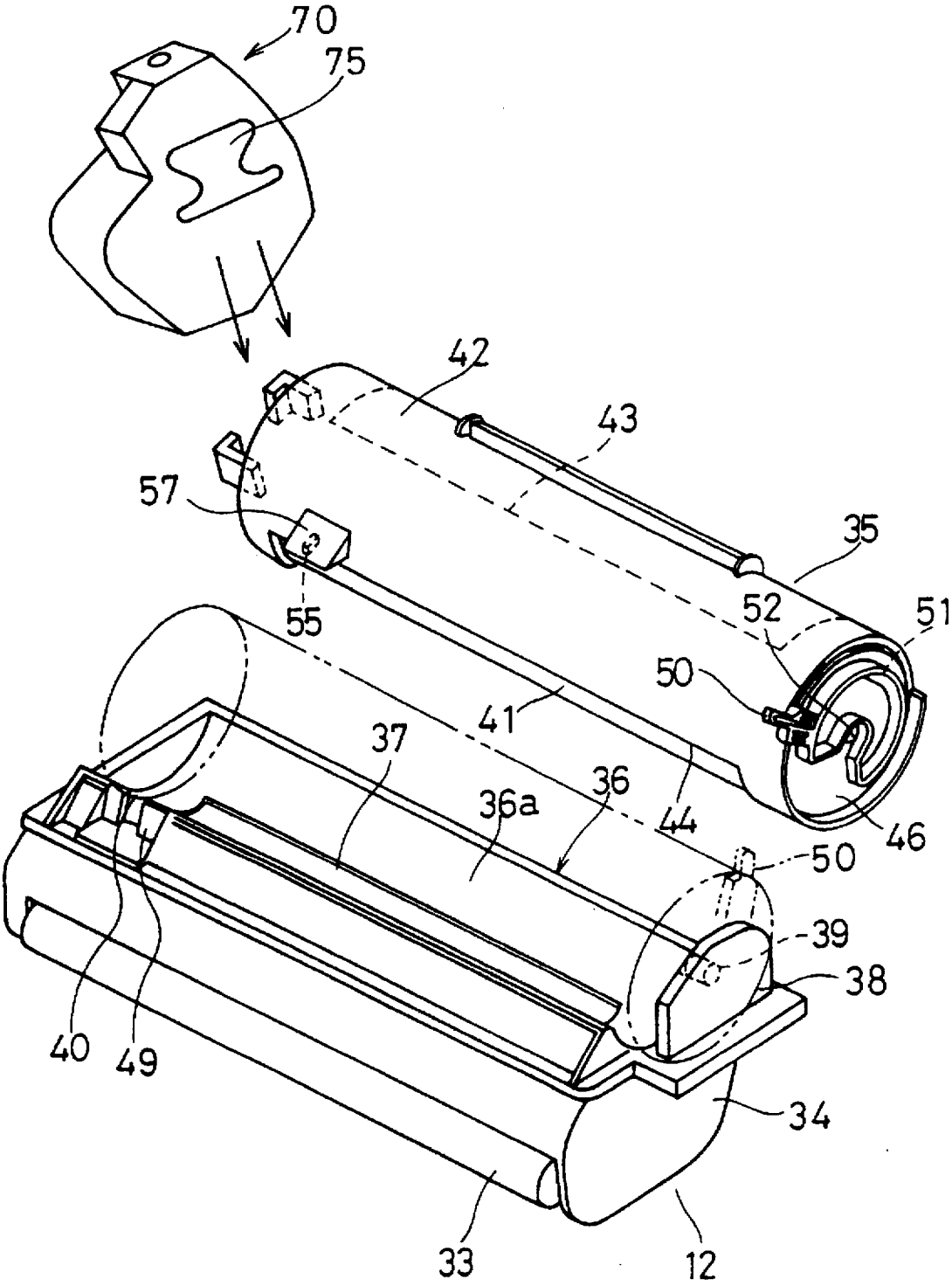
FIG. 3 is an oblique view of a developing unit for the facsimile device depicted in FIG. 1, showing a toner cartridge of the developing unit removed therefrom, with its operational location shown in phantom.

In the upper side end of the toner hopper 34, as shown in FIG. 3, is a toner cartridge installation seat 36 into which the toner cartridge 35 is fitted. The toner cartridge installation seat 36 has a curved recess **36*a* in the form of a sliced-off hollow cylinder. The curved recess 36*a* has a toner supply opening 37. A support bracket 38 projects from the near end, in FIG. 3, of the toner cartridge installation seat 36. A support pin 39 projects inward from the inside of the support bracket 38. Toward the far end (toward the upper left side in FIG. 3) of the toner hopper 34 is a lock release 40 for releasing a lock mechanism of the toner cartridge 35. The lock release 40 is an erected catch having triangularly-shaped lateral surfaces. Disposed on either side of the lock release 40 are anchoring clips 49 for securing the toner cartridge 35**.

The toner cartridge 35 includes an inner cylindrical member 41 and an outer cylindrical member 42 rotatable relative to and concentrically mounted around the inner cylindrical member 41. The inner cylindrical member 41 stores toner, and an opening 43 is formed along its peripheral surface. Formed in the peripheral surface of the outer cylindrical member 42 is an opening 44 which corresponds to the opening 43 of the inner cylindrical member 41. One end of the inner cylindrical member 41 is covered by a cover element 46, while the other end is covered by a cover element, not shown. One end of the outer cylindrical member 42 (toward the upper left in FIG. 3) is covered by a cover element, not shown, while the other end is free.

The cover member 46 of the inner cylindrical member 41 is provided with a rotation lever 50 for rotating the inner cylindrical member 41. The cover 46 is also provided with a rotation control part 51 for supporting the toner cartridge 35 when the inner cylindrical member 41 is rotated in response to movement of the rotation lever 50. The rotation lever 50 is formed on the rotation control part 51 and extends radially outward from the outer cylindrical member 42. The rotation lever 50 is freely rotatable between a dismount position, indicated by a solid lines in FIG. 3 and a mount position indicated by broken lines in FIG. 3. When the rotation lever 50 is in the dismount position, the opening 43 is located upward. When the rotation lever 50 is in the mount position, the opening 43 is located downward and is aligned with the opening 44.

The rotation control part 51 is formed with an attaching groove 52 which has a U-shaped, the bottom of the U being generally in the center of the rotation control part 51 and the outer cylindrical member 42. The support pin 39 projecting inward from the support bracket 38 is engageable with the attaching groove 52 such that the outer cylindrical member 42 may rotate on the support pin 39. Attached along the opening 43 of the inner cylindrical member 41 is a sealer (not shown) made of felt which is contacts the inner circumference of the outer cylindrical member 42. The sealer prevents scattering of the toner stored inside the inner cylindrical member 41.

Formed on the outer circumference of the inner cylindrical member 41 is a lock pawl 55 having a hook-shape which projects outwardly. An engaged dimple (not shown) is formed on the inner circumference of the outer cylindrical member 42 in the corresponding portion of the lock pawl 55. The position of the inner cylindrical member 41 relative to the outer cylindrical member 42 is fixed when the lock pawl 55 is engaged with the engaged dimple. In other words, when the lock pawl 55 engages the dimple, the inner cylindrical member 41 is unable to rotate within the outer cylindrical member 42.

Formed on the circumference of the outer cylindrical member 42 is a fixing member 57 which extends outward from the outer cylindrical member 42. The fixing member 57 is configured to project into the space between the lock release part 40 of the toner hopper 34 and the fixing receiver 49 provided with the both sides of the lock release part 40. When the outer cylindrical member 42 is inserted into the cartridge installation seat 36, the fixing member 57 covers the lock release part 40. In this situation, the lock release part 40 contacts the lock pawl 55. Contact between the lock release part 40 and the lock pawl 55 causes the lock pawl 55 to be urged outward and releases the lock pawl 55 from engagement with the engaged dimple (not shown), whereby the inner cylindrical member 41 may be relatively rotatable with respect the outer cylindrical member 42.

Figure 4:
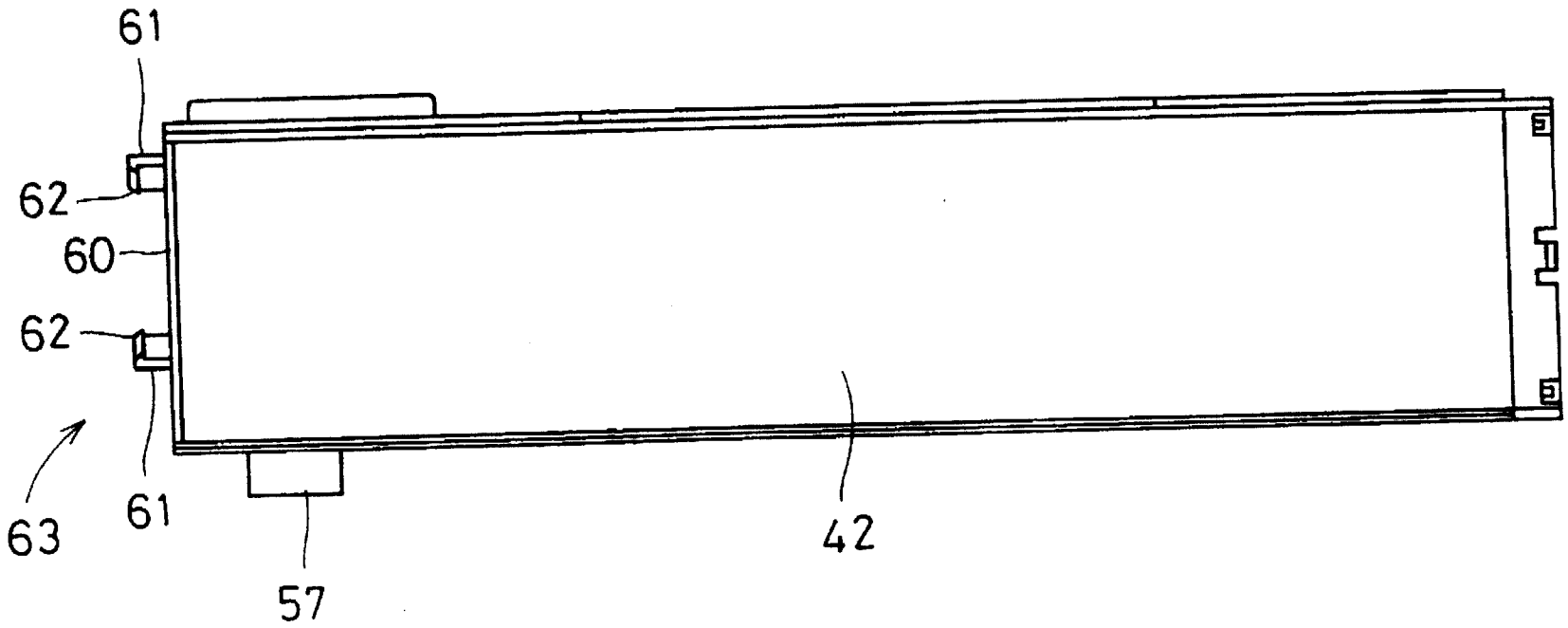
FIG. 4 is an elevation of the toner cartridge depicted in FIG. 3.

One end of the outer cylindrical member 42 is, as shown in FIG. 4, sealed by the cap member 60. The outer surface of the cap member 60 is provided with two projecting portions 61,61 projecting outward and forming a predetermined angle with the outer surface of the cap member 60. The head portion of each of the projecting portions 61,61 are provided with hook portions 62,62 which extend generally towards one another (i.e. at an obtuse angle). These two projecting portions 61,61 define a toner-cartridge-side joint portion 63, and are integrally formed with the outer cylindrical member 42 by, for instance, injection molding. The purpose of the toner-cartridge-side joint portion 63 is explained in greater detail below.

Figure 5:
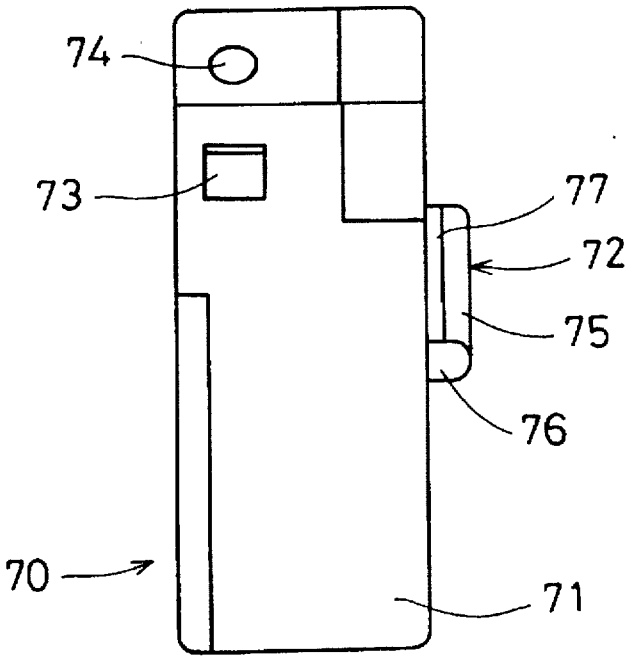
FIG. 5 is a front elevation of a collecting tank associated with the toner cartridge depicted in FIG. 4.
Figure 6:
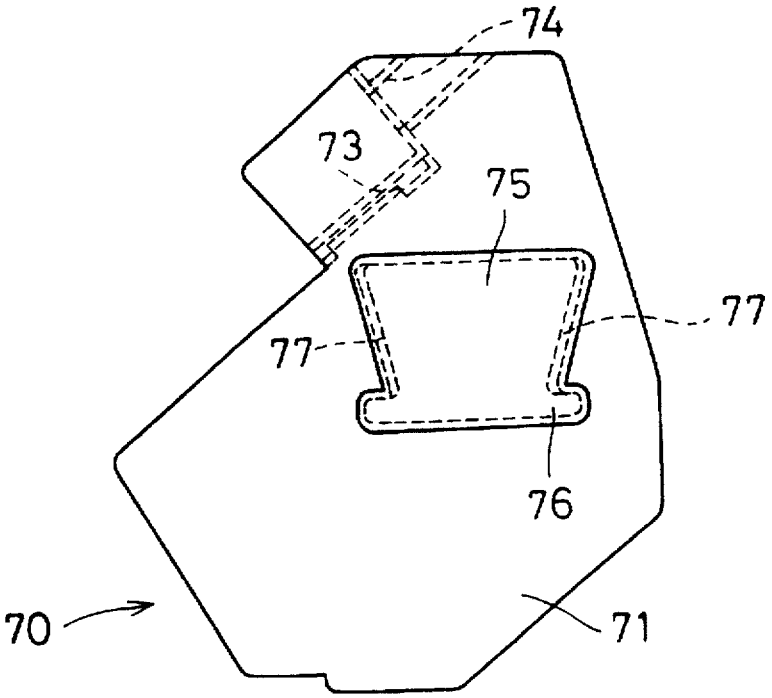
FIG. 6 is a side view of the collecting tank depicted in FIG. 5.

FIGS. 5–7 show a collecting tank 70 for collecting waste toner.

The collecting tank 70 includes a case body 71 for storing excess toner collected therein and a collecting-tank-side joint portion 72 provided on the side of the case body 71. The case body 71 has a toner collecting aperture 73 and a guide aperture 74. A guide member (not shown), such as a pipe, may extend through the guide aperture 74 and further extends over or into the toner collecting aperture 73 and guides excess toner into the collecting aperture 73. Consequently, the excess toner will be collected inside the case body 71.

The collecting-tank-side joint portion 72 has an engagement 75 which extends outwardly from the case body 71. The joint portion 72 has an inverted-trapezoid shape and includes a positioning portion 76, the width of which is broader than that of the bottom end portion of the engagement 75, and being integrally formed with the engagement 75.

Both sides of the engagement 75 are provided with engaged grooves 77,77 adapted to be engaged with hook portions 62,62 of the toner-cartridge-side joint portion 63. The collecting tank 70 is formed by, for instance, injection molding.

Figure 7A:
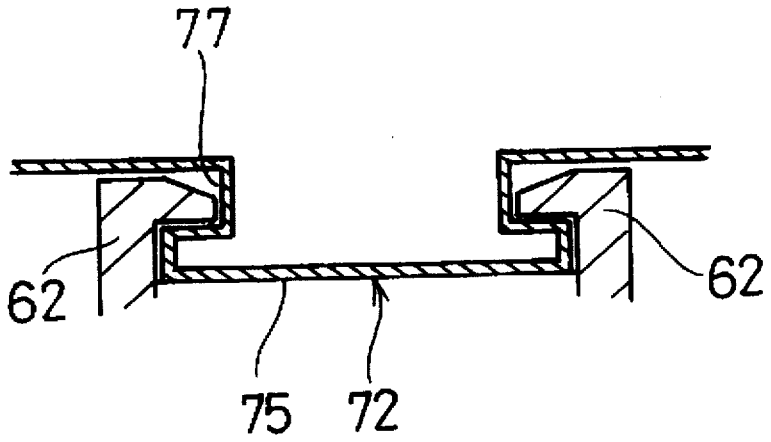
FIG. 7(A) is a cross-sectional view of the collecting tank depicted in FIG. 5 and the toner cartridge depicted in FIG. 4, showing hook portions 62 of the toner cartridge engaged with the grooves 77 of the collecting tank.

During installation of the toner cartridge 35 into the toner hopper 34, the hook portions 62,62 of the projecting portions 61,61 are engaged with the engaged grooves 77,77 of the collecting tank 70, whereby the collecting tank 70 is fixed to the toner cartridge 35. FIG. 7(A) shows in greater detail how the hook portions 62,62 of the toner cartridge 35 engage with the engaged grooves 77,77 of the collecting tank 70. The predetermined angle at which the projecting portions 61,61 are positioned on the cap member 60, are such that there is firm engagement between the hook portions 62, 62 and the engagements 75 of the collecting tank 70. This affords ease of operation in installation. Likewise, the positioning part 76 is provided beneath the engagement 75, which enables the collecting tank 70 to be firmly attached to the toner cartridge 35 without relative movement therebetween.

Accordingly, installing the toner cartridge 35 to the toner hopper 34 and installing the collecting tank 70 to the toner hopper 34 can be done at the same time. Moreover, in replacing of the toner cartridge 35, the collecting tank can also be detached from the body. Consequently, the number of operation steps can be reduced. The toner cartridge 35 may be made of hard synthetic resin by injection molding and the collecting tank 70 is made of flexible synthesis resin by blow molding and both can be readily detachable from one another due to the respective joint portions 63,72.

Second Embodiment

A toner cartridge in accordance with the second embodiment of the present invention is shown in FIGS. 8–12.

Figure 8:
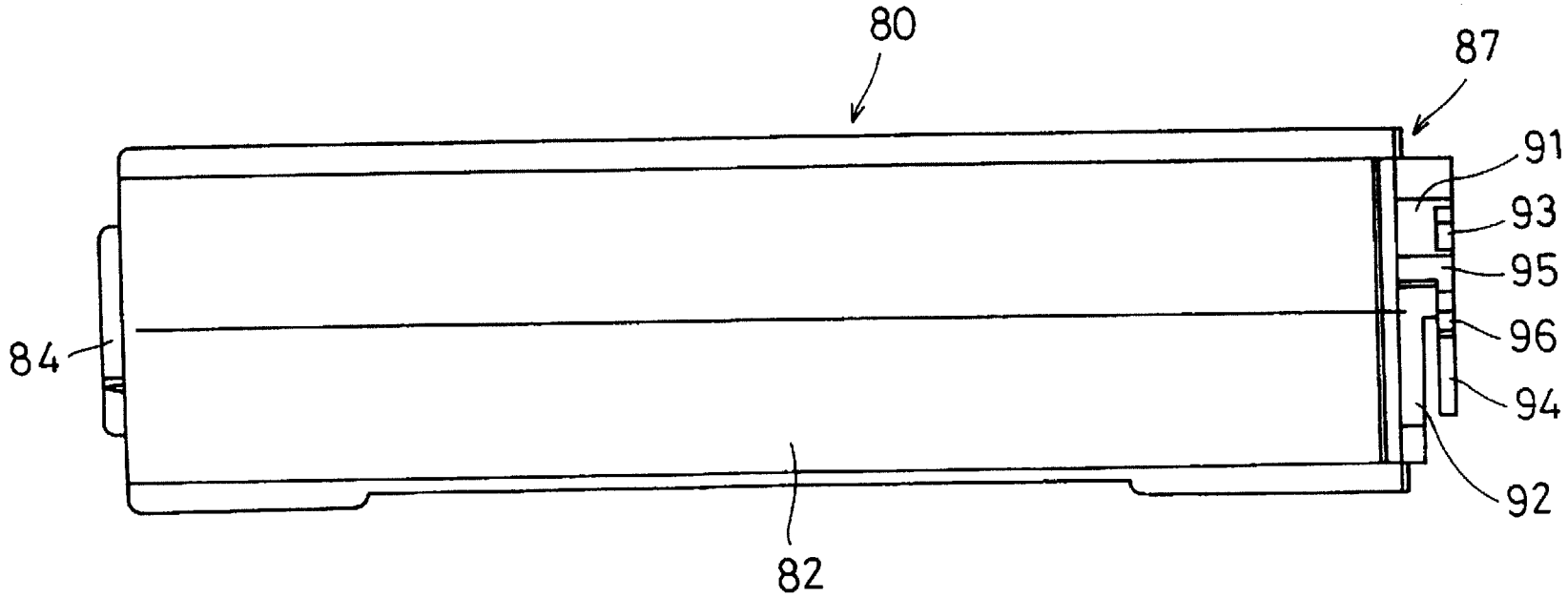
FIG. 8 is a top view of a toner cartridge in accordance with a second embodiment of the present invention.
Figure 9:
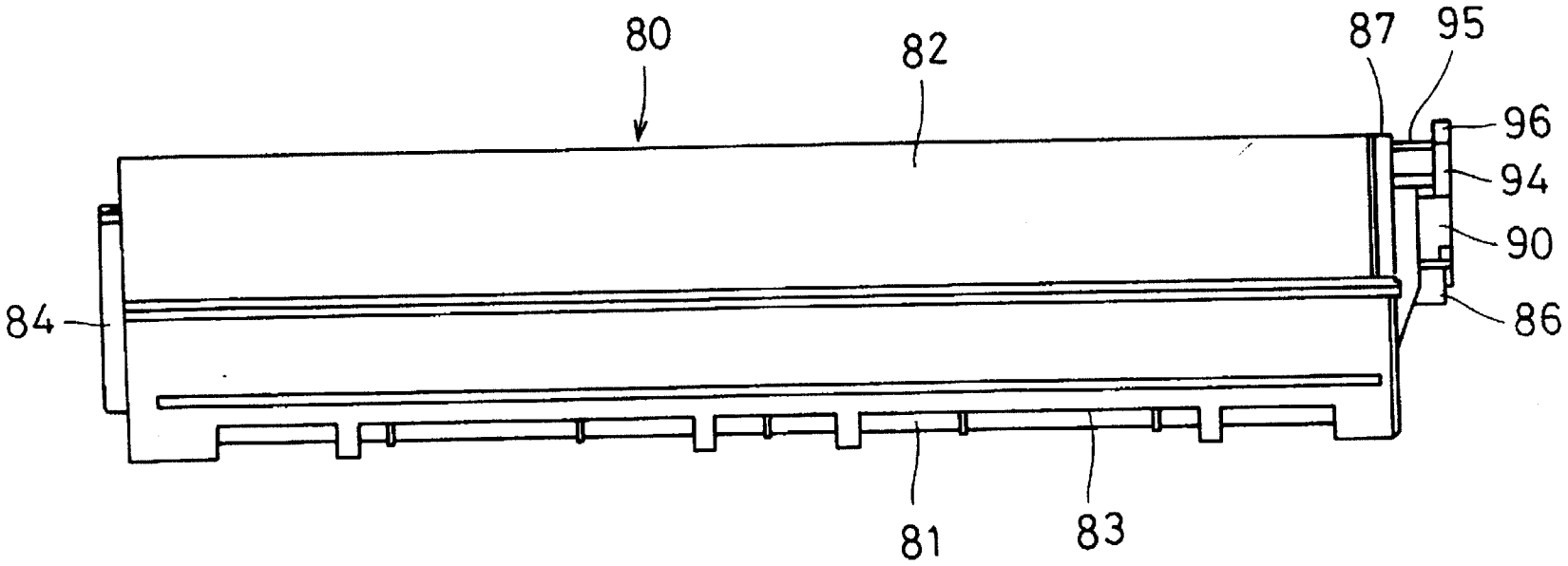
FIG. 9 is a front elevation view of the toner cartridge depicted in FIG. 8.
Figure 10:
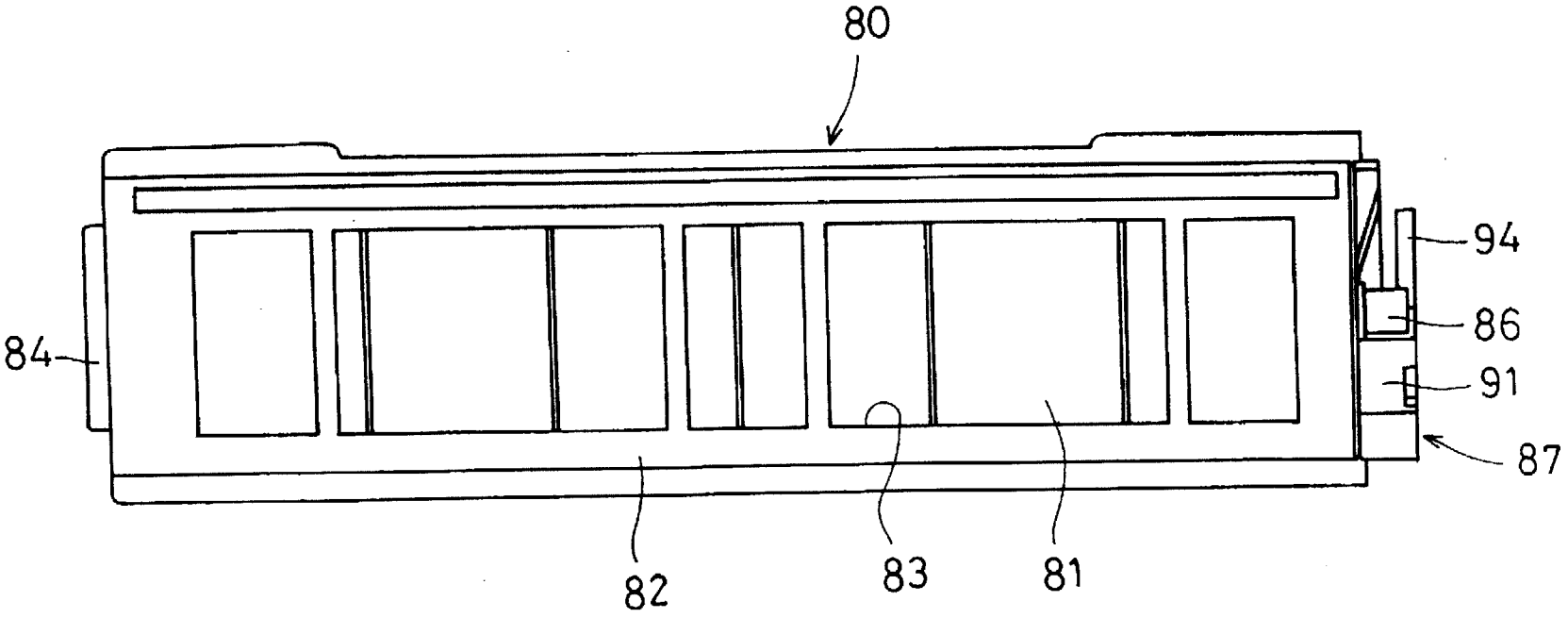
FIG. 10 is a bottom end view of the toner cartridge depicted in FIG. 8.
Figure 11:
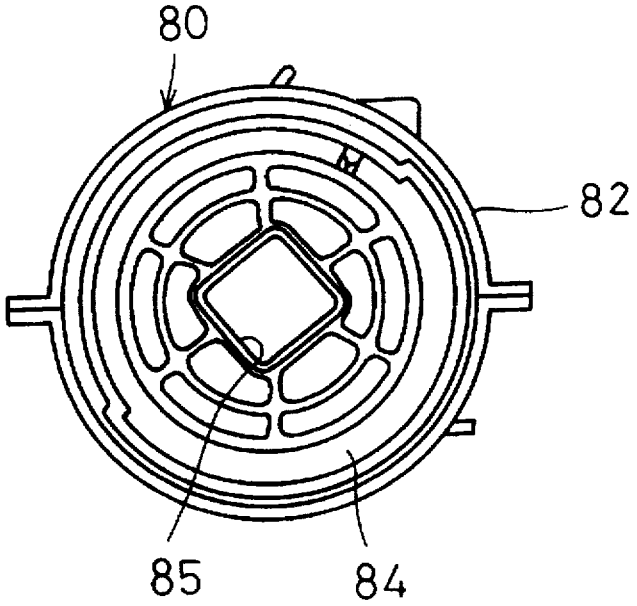
FIG. 11 is a left side view, in the orientation of FIG. 8, of the toner cartridge depicted therein.

The toner cartridge 80 includes an inner cylindrical member 81 which is cylindrical in shape, and an outer cylindrical member 82 which is configured so as to be relatively rotatable with respect to the inner cylindrical member 81 in a manner similar to the corresponding cylindrical components in the first embodiment (described above). The outer circumference of the outer cylindrical member 82 is formed with an opening 83 for discharging toner, as shown in FIGS. 9 and 10. The outer circumference of the inner cylindrical member 81 has an opening (not shown) which corresponds to the opening 83 of the outer cylindrical member 82. One end of the inner cylindrical member 81 is covered by a cover member 84, shown in FIGS. 8, 9, 10 and 11. With reference to FIG. 11, the center part of the cover member 84 is formed with a positioning aperture 85 which can be engaged with a rotation support rod 120 provided on the developing apparatus, as is described in greater detail below with respect to FIGS. 17, 18 and 20.

Figure 12:
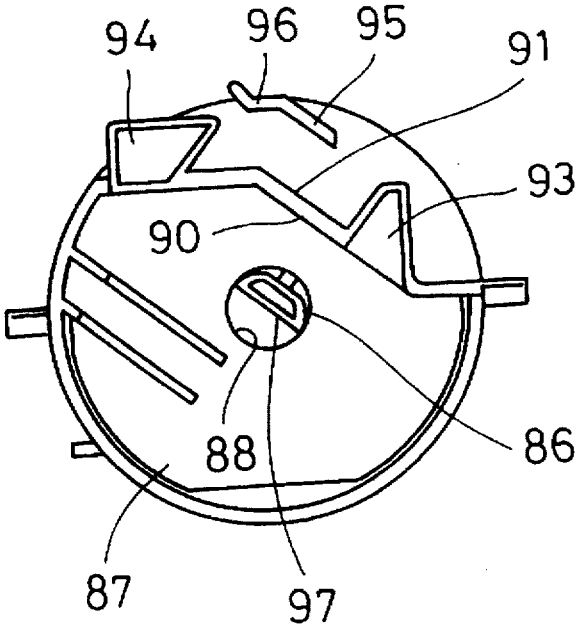
FIG. 12 is a right side view, in the orientation of FIG. 8, of the toner cartridge depicted therein.

The positioning aperture 85 has a square shape corresponding to the cross section of the rotation support rod 120. The cross section of the positioning aperture 85 is shown with a square shape, but it should be understood that any of a variety of shapes may be used, such as a D-shape or a triangular shape, providing the rotation support rod has a corresponding shape. The opposite end of the inner cylindrical member 81, opposing the cover member 84 of the inner cylindrical member 81, is covered by a cover member (not shown). A support rod 86 extends through the center part of the cover member (not shown) as indicated in FIG. 12. The support rod 86 is roughly semicircular, and includes a planer section 97. The planer section 97 is formed such that during installation of the toner cartridge 80, the planer section 97 is parallel to the direction of movement of the toner cartridge 80 when the outer circumference of the inner cylindrical member 82 is covering the opening 83 of the outer cylindrical member 82.

A cover member 87 is further provided on the outer cylindrical member 82, on the end opposite the cover member 84. In the center part of the cover member 87 is formed a support aperture 88 for supporting the support rod 86. The cover member 87 includes an attach guide member 90 that facilitates the guidance and alignment of the toner cartridge 80 when it is installed in the developing apparatus, as is described in greater detail below.

The attach guide member 90 also acts as the installation guide in installing a collecting tank 100, as is described in greater detail below. The attach guide member 90 includes a collecting-tank-guide-surface 91 which is shaped to guide the toner cartridge 80 during installation, and supporting member 92 bent downwards to facilitate the installation of the collecting tank 100.

Further, the attach guide member 90 includes a first positioning member 93 of the collecting-tank-guide-surface 91. The first positioning member 93 extends downwards to facilitate installing the collecting tank 100. A second positioning member 94 is laterally spaced from the support member 92, as shown in FIG. 8. The second positioning member 94 is made of resilient material. Moreover, a second guide member 95 is spaced apart from the attach guide member 90. The attach guide member 95 is placed so as to be roughly parallel to the attach guide member 90, and a third positioning member 96 extends upward. The third positioning member 96, being resilient, is spaced from the side of the cover member 87 and is roughly parallel to the support member 92.

Figure 13:
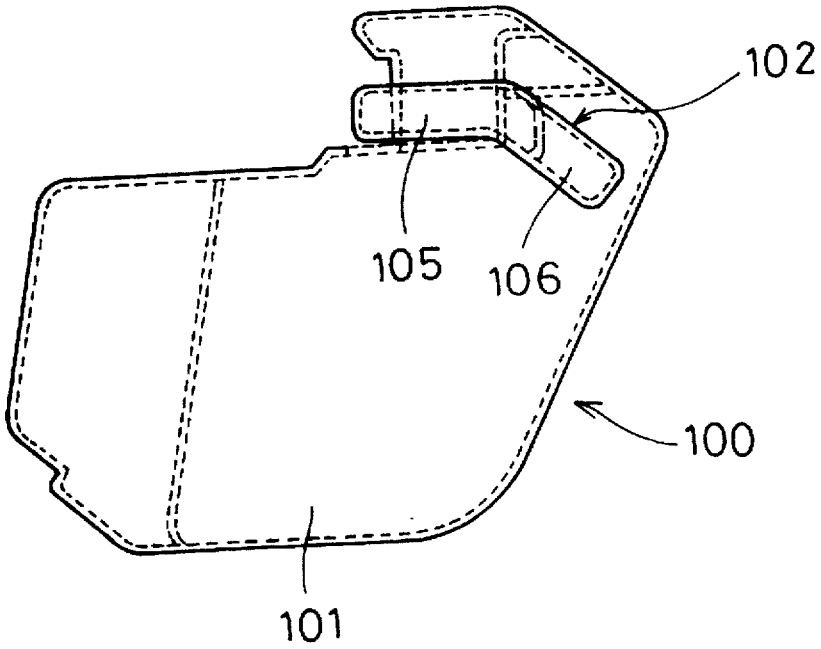
FIG. 13 is a side view of a collecting tank associated with the toner cartridge depicted in FIG. 8.
Figure 14:
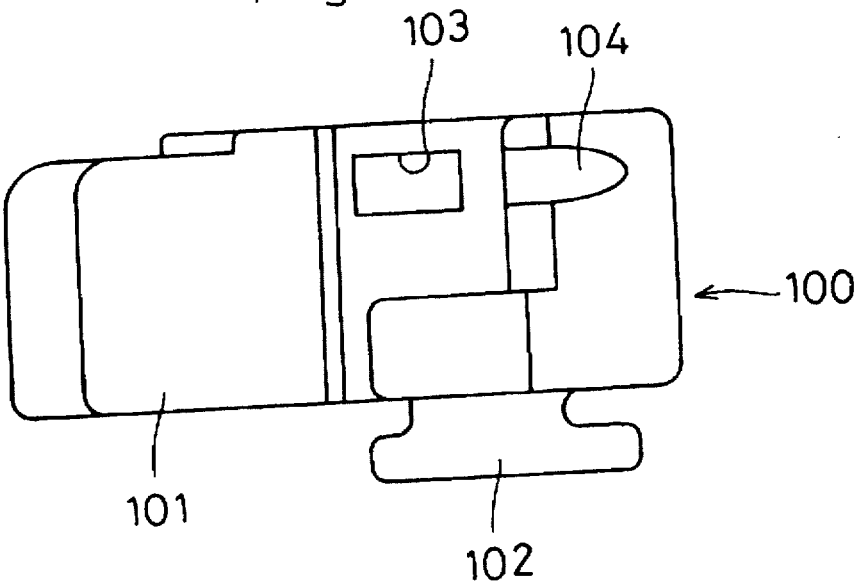
FIG. 14 is a top view of the collecting tank depicted in FIG. 13.
Figure 15:
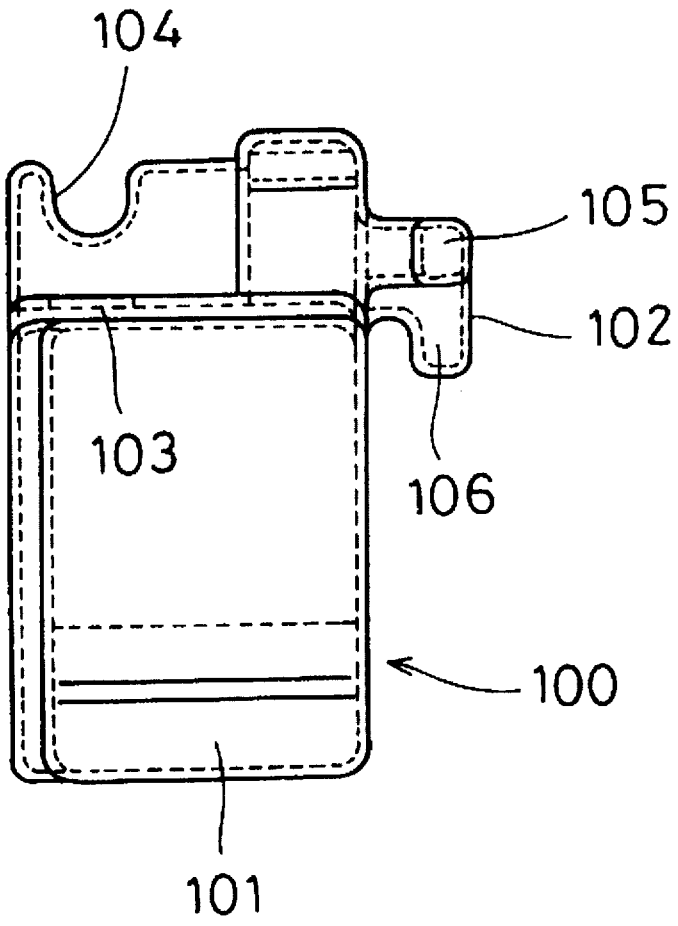
FIG. 15 is a rear end view of the collecting tank depicted in FIG. 13.

A collecting tank 100 connected to the toner cartridge 80 is shown in FIGS. 13–15.

The collecting tank 100 includes a case body 101 for storing excess toner collected therein and a collecting-tank-side joint portion 102 provided on the side of the case body 101. The case body 101 has a toner collecting aperture 103 and a guide aperture 104. A guide member such as a pipe for guiding the excess toner extends through the guide aperture 104, and further extends through the toner collecting aperture 103. Consequently, the excess toner will be collected into the case body 101.

The collecting-tank-side joint portion 102 has a guide projection 105 which is formed to be roughly parallel to the direction the case body 101 moves during installation of the collecting tank. Further, the joint portion 102 includes a positioning projection 106 which extends from the guide projection 105 and extends at a predetermined angle from the guide projection 105.

Figure 16:
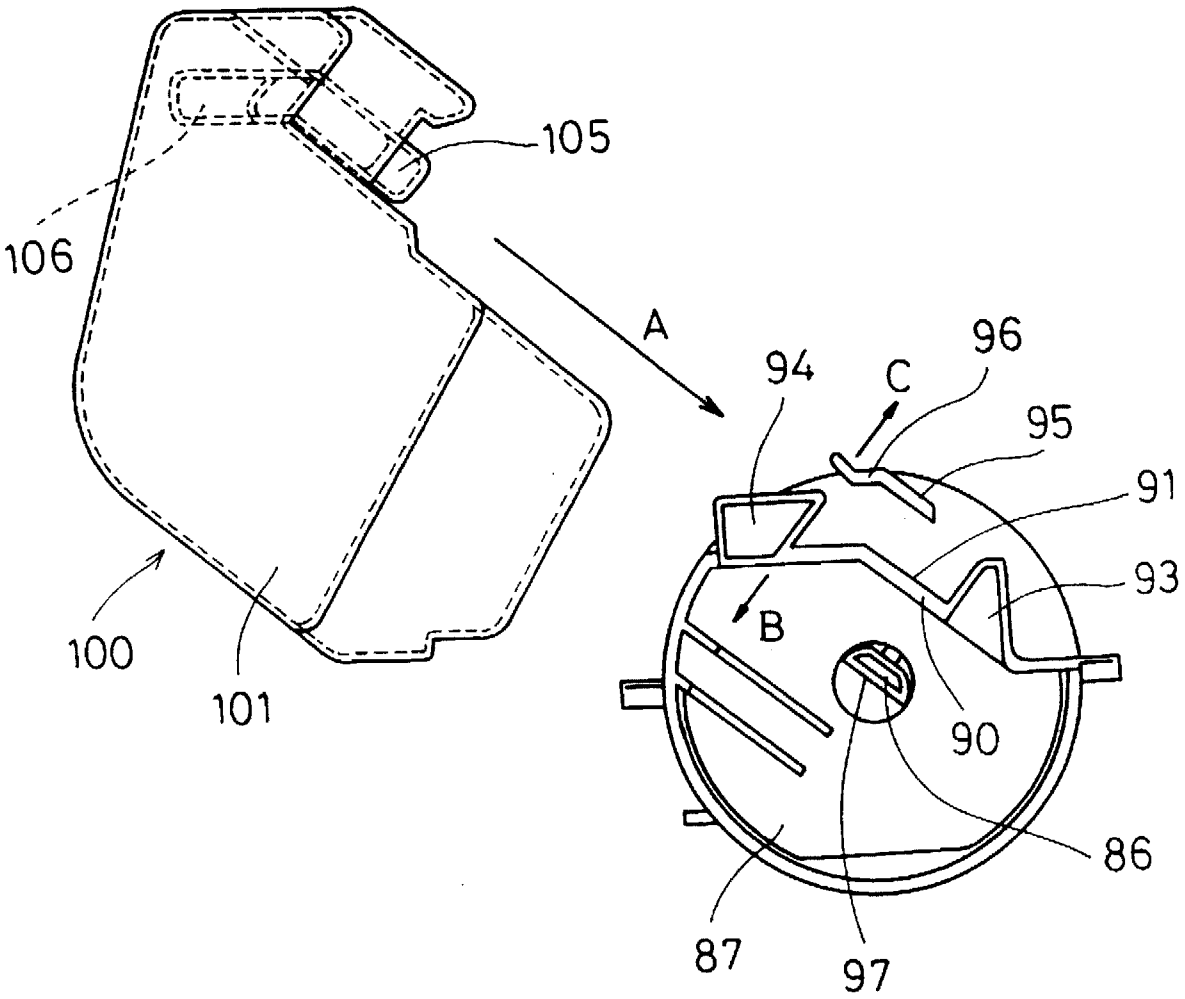
FIG. 16 is a view illustrating installation of the collecting tank depicted in FIG. 13 onto the toner cartridge depicted in FIG. 8.

The collecting tank 100, as shown in FIG. 16, is connected to one side of the toner cartridge 80 by inserting the collecting-tank-joint portion 102 into the portion between the attach guide member 90 of the toner cartridge 80 and the second guide member 95. In this case, the second positioning member 94 flexes in the direction indicated by the arrow B and the third positioning member 96 flexes in the direction indicated by the arrow C, which allows the guide projection 105 to be slid into position between the attach guide member 90 and the second guide member 95. During installation, the collecting tank 100 moves in the direction indicated by the arrow A in FIG. 16. The desired position of the collecting tank 100 is achieved in both the lateral direction and in the longitudinal direction of the collecting tank 100 when the guide projection 105 is located between the collecting-tank-guide surface 91 and the second guide member 95, and the positioning projection 106 is located between the support member 92 and the third positioning member 96 at the collecting tank 100 side.

The guide projection 105 and the positioning projection 106 are retained in position in the direction perpendicular to the plane of FIG. 16 by means of the first positioning member 93 and the second positioning 94, respectively. This makes the collecting tank firmly connected to the side of the toner cartridge 80. Moreover, because the second positioning member 94 and the third positioning member 96 are composed of a resilient material, the collecting tank 100 is easily positioned and easily connected and disconnected.

Figure 18:
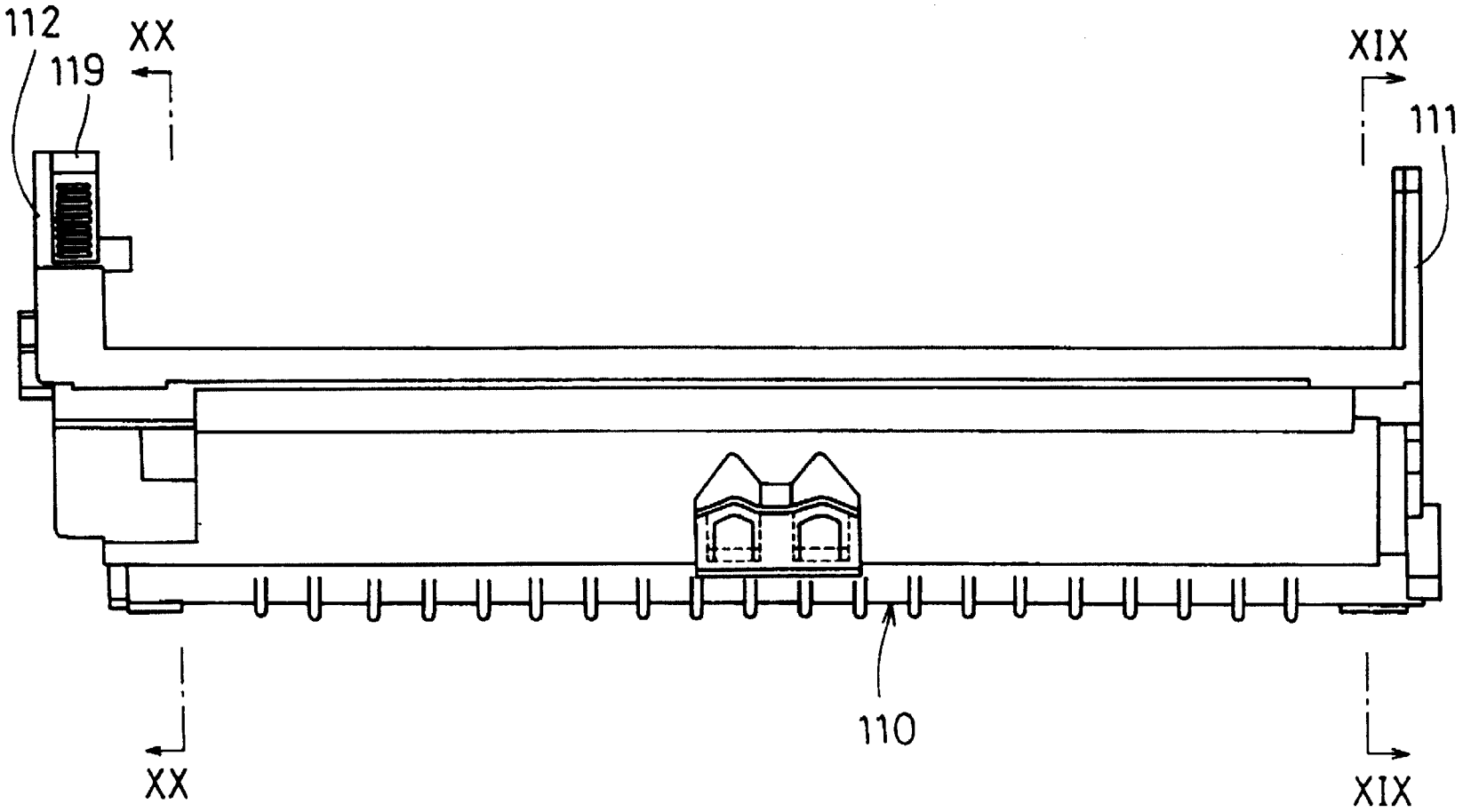
FIG. 18 is a front elevation view of the toner cartridge installation portion depicted in FIG. 17, shown removed from the collecting tank.

During installation onto the toner cartridge 80, the collecting tank 100 is moved in the direction A, as shown in FIG. 18. Further, during installation of the toner cartridge 80 into the cartridge installing portion 110, the toner cartridge 80 moves generally in the same direction as indicated by the direction A in FIG. 16. Therefore, when installing the collecting tank 100 onto the toner cartridge 80, the direction of movement of the collecting tank 100 is the same as the direction of movement of the toner cartridge 80 onto the cartridge installing portion 110. Therefore, the collecting tank 100 can also be connected to the toner cartridge 80 after installing the toner cartridge 80 to the cartridge installing portion 110 or developing apparatus.

A cartridge installing portion 110 employed in the second embodiment will be described in accordance with FIG. 17–20.

Figure 17:
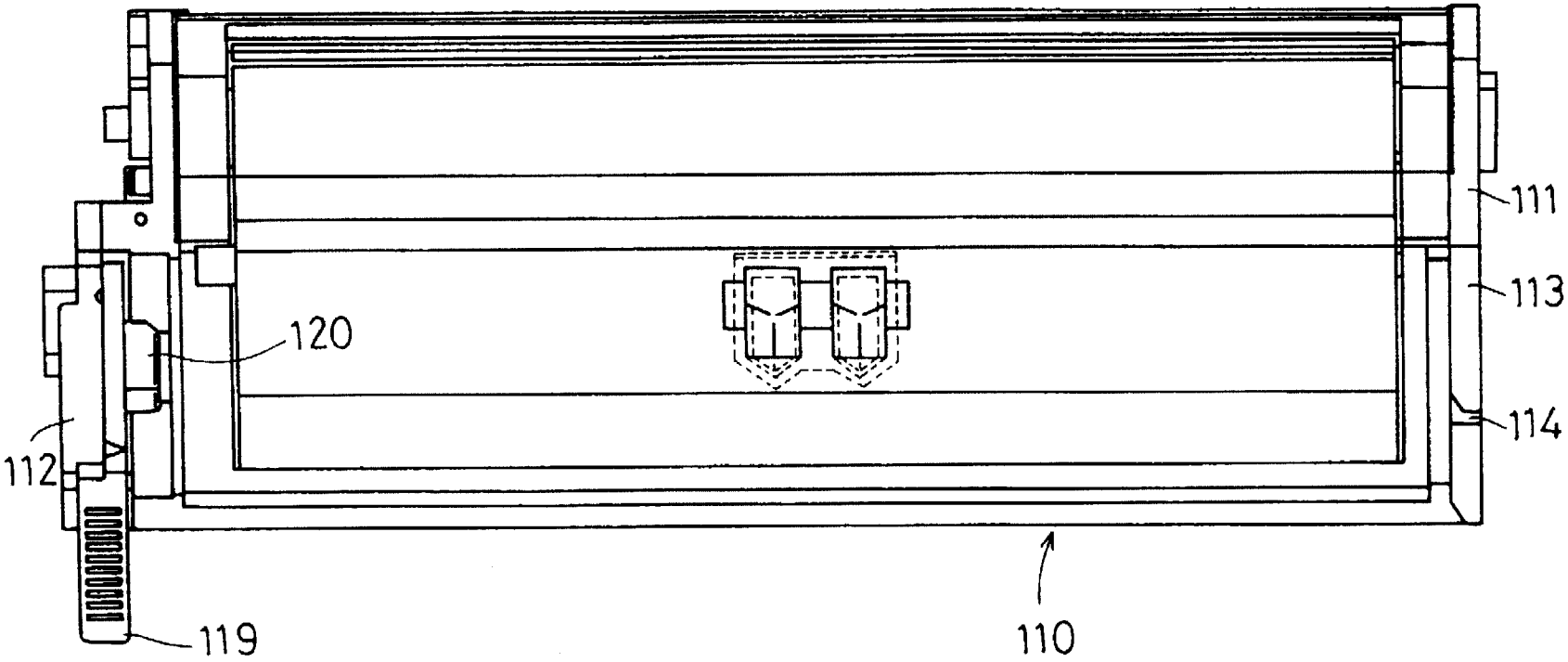
FIG. 17 is a plan view of a toner cartridge installation portion of the collecting tank depicted in FIG. 13.
Figure 19:
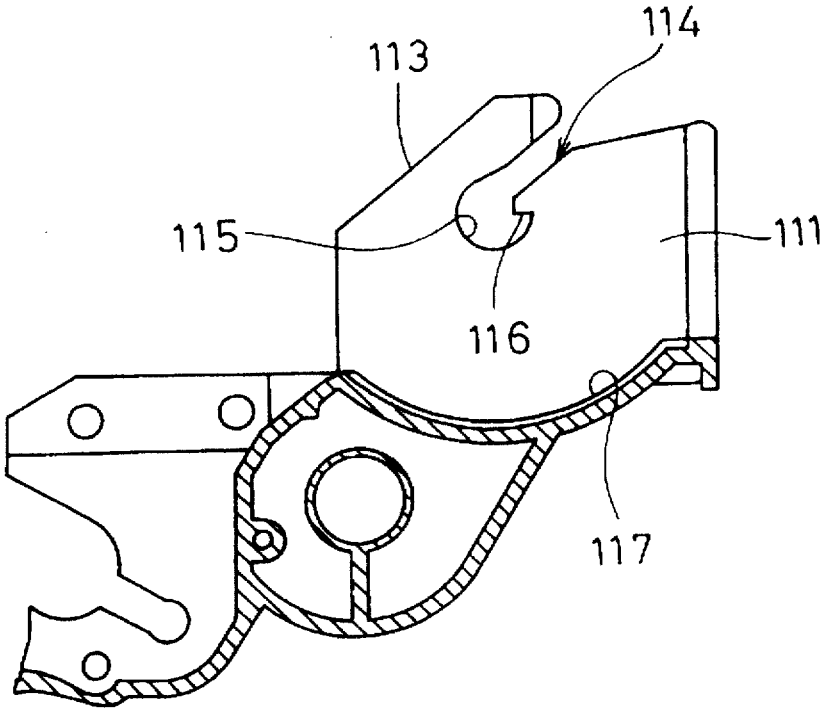
FIG. 19 is a cross sectional view of the cartridge installation portion depicted in FIG. 18, taken along the line XIX—XIX of FIG. 18 looking in the direction of the arrows.

The cartridge installing portion 110 has a generally rectangular shape whose upper portion is open, as is shown in FIGS. 17 and 18. The cartridge installing portion 110 has side walls 111 and 112 at opposing ends. One side wall 111 has a cartridge guide surface 113 which extends in a direction corresponding to the movement of the toner cartridge 80 during installation. The side wall 111 is also formed with a support-rod-guide slot 114, shown in FIG. 21. The end of the slot 114 generally defines an aperture 115 for supporting support rod 86. On one portion of the side wall 111, the aperture 115 is further defined by engagement 116 which projects inward into the aperture 115. The engagement 116 engages the planer surface 97 of the support rod 86 of the toner cartridge 80 when the toner cartridge is installed in the cartridge installing portion 110. As is shown in FIG. 19, the bottom end of the side wall 111 is formed with a supporting portion 117 that has a curved contour for supporting one end of the toner cartridge 80.

Figure 20:
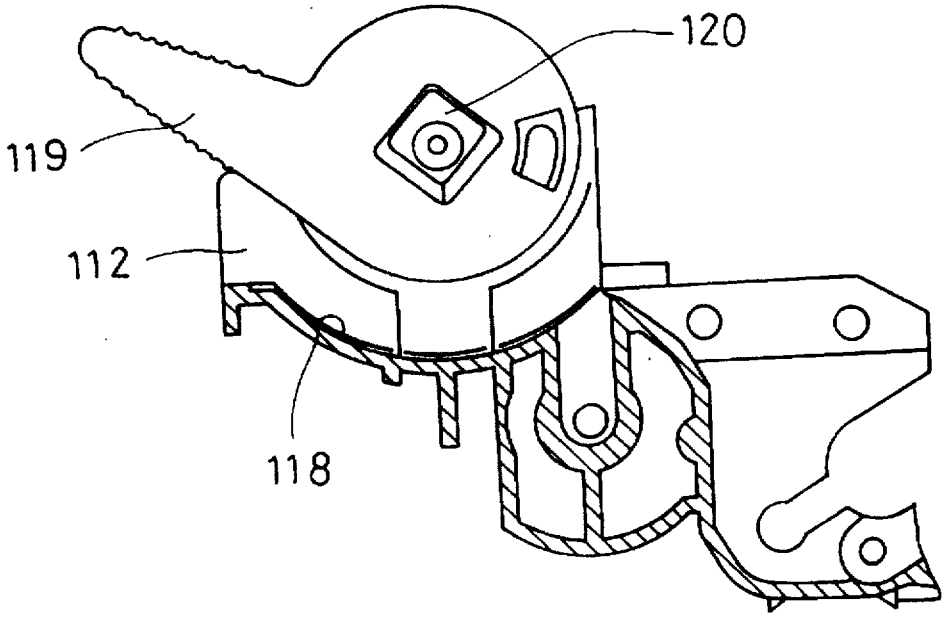
FIG. 20 is a cross sectional view of the cartridge installation portion depicted in FIG. 18, taken along the line XX—XX of FIG. 18 looking in the direction of the arrows.

The side wall 112, provided on the other end of the cartridge installing portion 110, is opposed to the side wall 111. At the bottom end of the side wall 112, as shown in FIG. 20, a supporting portion 118 is formed having a curved contour similar to that of the supporting portion 117. The supporting portion 118 is for supporting the other end of the toner cartridge 80.

The inside of the side wall 112 is also provided with a rotation lever 119 relatively rotatable to the cartridge installing portion 110. The rotation support rod 120 projects inward from the rotation lever 119 in a generally central position. The rotation support rod 120 has a shape corresponding to the positioning aperture 85 of the toner cartridge 80 such that the support rod 120 may extend into the aperture 85, as indicated in FIG. 21.

Figure 21:
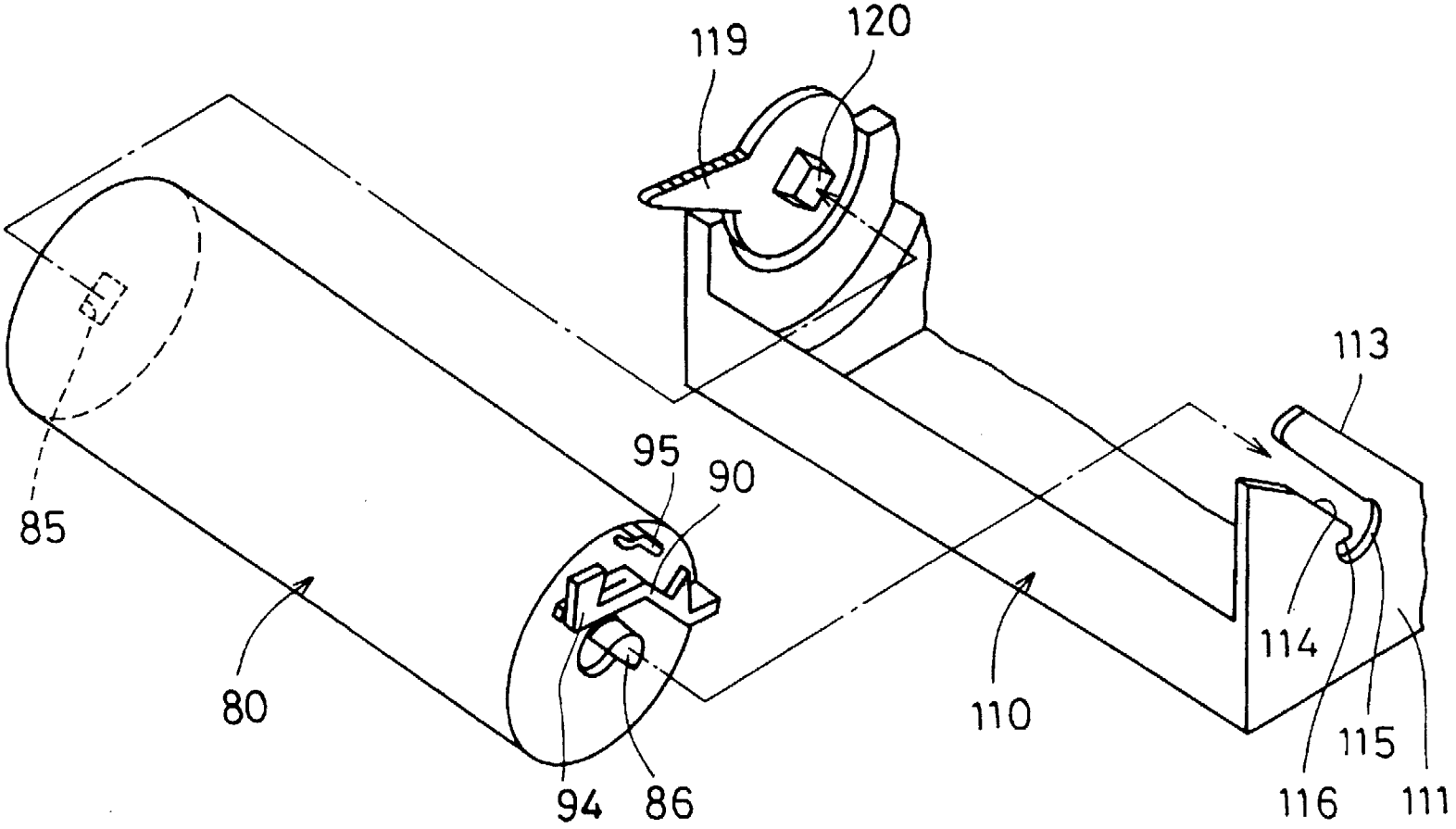
FIG. 21 is a view schematically illustrating installation of a toner cartridge into the installation portion of the collecting tank in accordance with the second embodiment.

In installing the toner cartridge 80 into the cartridge installing portion 110, as shown in FIG. 21, the rotation support rod 120 of the cartridge installing portion 110 is engaged with the positioning aperture 85 of the cover member 84 and extends through the positioning aperture 85 so as to facilitate pivot movement of the inner cylindrical member 81 about the positioning aperture 85 in the radial direction. In this case, the toner cartridge 80 is guided into the appropriate position by sliding the guide member 90 on the cartridge guide surface 113 of the cartridge installing portion 110 and inserting the support rod 86 into the support rod guide slot 114.

When the toner cartridge 80 is placed in the appropriate position, the support rod 86 is held in the aperture 115 formed on the side wall 111. In this state, by pushing on the rotation lever 119, the rotation support rod 120 may be pivoted. In response to movement of the rotation lever 119, the inner cylindrical member 81 relatively rotates within the outer cylindrical member 82 which allows the opening (not shown) in the inner cylindrical member 81 to be aligned with the opening 83 in the outer cylindrical member 80. Consequently, the toner stored in the toner cartridge 80 may be supplied into the toner hopper through the opening 83.

When the toner cartridge 80 is installed into the cartridge installing portion 110, the support rod 86 of the inner cylinder 81 is easily guided into the aperture 115 because the planer surface 97 is parallel to the support rod guide slot 114. Moreover, when the rotation lever is operated the support rod 120 may be used to rotate the inner cylindrical member 81, and the planer surface 97 of the support rod 86 may then engage the engagement 116 of the aperture 115. Therefore, the toner cartridge 80 is not detachable from the cartridge installing portion 110 when the opening 83 is open.

In the present invention, the direction A of movement when installing the toner cartridge 80 into the cartridge installing portion 110 and the direction A of movement of the collecting tank 100 when connecting the collecting tank 100 to the toner cartridge 80 are the same and therefore the collecting tank 100 may be easily connected and disconnected even after the installation of the toner cartridge 80 to the cartridge installing portion 110.

The toner cartridge provided in the image forming apparatus according to the present invention enables the replacement of the collecting tank as well as the replacement of the toner cartridge at the same time. Moreover, the present invention facilitates the installing or detaching of the toner cartridge and collecting tank, and affords ease of operation in assembling or disassembling components.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A toner cartridge for an image forming apparatus, comprising:

a toner cartridge main body, said toner cartridge main body having on an exterior surface thereof a collecting tank support portion formed integrally with said toner cartridge mainbody, said collecting tank support portion having two opposing hooks extending outward from said exterior surface of said toner cartridge main body and said opposing hooks inclined with respect to one another at an obtuse angle, and a means for installing said toner cartridge main body into a developing unit of an image forming apparatus; and a collecting tank for collecting useless toner, said collecting tank having on an exterior surface thereof a support member corresponding to and engaging said collecting tank support portion;

whereby said collecting tank and said toner cartridge main body are configured to be installable and removable as a unit from said developing unit.

2. The toner cartridge for an image forming apparatus as in claim 1 wherein said toner cartridge main body is formed integrally by injection molding.

3. The toner cartridge for an image forming apparatus as in claim 1 wherein said support member of said collecting tank is configured to be gripped between said hooks.

4. The toner cartridge for an image forming apparatus as in claim 1 wherein said support member of said collecting tank protrudes outwardly from said collecting tank and defines a pair of grooves engageable with said hooks.

5. The toner cartridge for an image forming apparatus as in claim 1 wherein said collecting tank is formed integrally by blow molding.

6. The toner cartridge for an image forming apparatus as in claim 1 wherein said means for installing said toner cartridge main body into said developing unit of said image forming apparatus comprises a fixing member formed on said toner cartridge main body which conforms to a fixing receiver formed on said developing unit.

7. The toner cartridge for an image forming apparatus as in claim 1 wherein said means for installing said toner cartridge main body into a developing unit of an image forming apparatus further comprises a rotation control part formed on an axial surface or said toner cartridge main body to facilitate rotation of said toner cartridge main body within said developing unit.

8. The toner cartridge for an image forming apparatus as in claim 1 wherein said toner cartridge main body further comprises an inner cylindrical member and an outer cylindrical member, said inner cylindrical member concentrically disposed within said outer cylindrical member.

9. The toner cartridge for an image forming apparatus as in claim 1 wherein said collecting tank is configured to be installable and removable from said toner cartridge main body with said toner cartridge main body installed in said developing unit.

10. A toner cartridge for an image forming apparatus, comprising:

a toner cartridge main body having on an exterior surface thereof a collecting tank support portion and a means for installing said toner cartridge main body into a developing unit of an image forming apparatus, said toner cartridge main body configured to be installed in said developing unit in a predetermined direction; and a collecting tank for collecting useless toner, said collecting tank having on an exterior surface thereof a support member corresponding to and engaging said collecting tank support portion, said support member of said collecting tank having a guide projection extending towards said predetermined direction for installing said toner cartridge main body, and a positioning projection formed on an upward end of said predetermined direction of said support member;

said collecting tank support portion including guide members which can be engaged with said guide projection and positioning members which can keep said positioning projection and hold the position of said collecting tank;

whereby said collecting tank and said toner cartridge main body are configured to be installable and removable as a unit from said developing unit.

11. The toner cartridge for an image forming apparatus as in claim 10 wherein said toner cartridge main body is formed integrally by injection molding.

12. The toner cartridge for an image forming apparatus as in claim 10 wherein said collecting tank is formed integrally by blow molding.

13. The toner cartridge for an image forming apparatus as in claim 10 wherein said guide members are made of resilient material, extend from the side of said toner cartridge main body toward said collecting tank and having two projecting guide portions which hold said guide projection.

14. The toner cartridge for an image forming apparatus as in claim 10 wherein said means for installing said toner cartridge main body into said developing unit of said image forming apparatus comprises a fixing member formed on said toner cartridge main body which conforms to a fixing receiver formed on said developing unit.

15. The toner cartridge for an image forming apparatus as in claim 10 wherein said means for installing said toner cartridge main body into a developing unit of an image forming apparatus further comprises a rotation control part formed on an axial surface of said toner cartridge main body to facilitate rotation of said toner cartridge main body within said developing unit.

16. The toner cartridge for an image forming apparatus as in claim 10 wherein said toner cartridge main body further comprises an inner cylindrical member and an outer cylindrical member, said inner cylindrical member concentrically disposed within said outer cylindrical member.

17. The toner cartridge for an image forming apparatus as in claim 16 wherein said inner cylindrical member includes a shaft which extends therethrough, and said outer cylindrical member is formed with a cover having a central aperture, said shaft extending through said central aperture.

18. The toner cartridge for an image forming apparatus as in claim 17 wherein one end of said shaft is formed with a flat surface generally parallel to a central axis of said shaft.

19. The toner cartridge for an image forming apparatus as in claim 18 wherein said developing unit is formed with an end wall having a slot formed therein, an inner portion of said slot defining a shaft retaining portion whereby said flat surface of said shaft is engageable with said shaft retaining portion in response to installation of said toner cartridge main body into said developing unit and rotation of said inner cylindrical member.

20. The toner cartridge for an image forming apparatus as in claim 10 wherein said collecting tank is configured to be installable and removable from said toner cartridge main body with said toner cartridge main body installed in said developing unit.

21. A toner cartridge for an image forming apparatus, comprising:

a toner cartridge main body which includes an inner cylindrical member and an outer cylindrical member, said inner cylindrical member concentrically disposed within said outer cylindrical member, said toner cartridge main body further including on an exterior surface thereof a collecting tank support portion having two opposing hooks which extend outwardly from an axial exterior surface of said inner cylindrical member, and a means for installing said toner cartridge main body into a developing unit of an image forming apparatus; and a collecting tank for collecting useless toner, said collecting tank having on an exterior surface thereof a support member corresponding to and engaging said collecting tank support portion;

whereby said collecting tank and said toner cartridge main body are configured to be installable and removable as a unit from said developing unit.

22. The toner cartridge for an image forming apparatus as in claim 21 wherein said two opposing hooks are inclined with respect to one another at a predetermined angle.

23. The toner cartridge for an image forming apparatus as in claim 21 wherein said toner cartridge main body is formed integrally by injection molding.

24. The toner cartridge for an image forming apparatus as in claim 21 wherein said support member of said collecting tank is configured to be gripped between said hooks.

25. The toner cartridge for an image forming apparatus as in claim 21 wherein said support member of said collecting tank protrudes outwardly from said collecting tank and defines a pair of grooves engageable with said hooks.

26. The toner cartridge for an image forming apparatus as in claim 21 wherein said collecting tank is formed integrally by blow molding.

27. The toner cartridge for an image forming apparatus as in claim 21 wherein said means for installing said toner cartridge main body into said developing unit of said image forming apparatus comprises a fixing member formed on said toner cartridge main body which conforms to a fixing receiver formed on said developing unit.

28. The toner cartridge for an image forming apparatus as in claim 21 wherein said means for installing said toner cartridge main body into a developing unit of an image forming apparatus further comprises a rotation control part formed on an axial surface of said toner cartridge main body to facilitate rotation of said toner cartridge main body within said developing unit.

29. The toner cartridge for an image forming apparatus as in claim 21 wherein said collecting tank is configured to be installable and removable from said toner cartridge main body with said toner cartridge main body installed in said developing unit.

30. A toner cartridge for an image forming apparatus, comprising:

a toner cartridge main body which includes an inner cylindrical member and an outer cylindrical member, said inner cylindrical member concentrically disposed within said outer cylindrical member, said inner cylindrical member including a shaft which extends therethrough, and said outer cylindrical member is formed with a cover having a central aperture through which said shaft extends, said toner cartridge main body further having on an exterior surface thereof a collecting tank support portion and a means for installing said toner cartridge main body into a developing unit of an image forming apparatus; and a collecting tank for collecting useless toner, said collecting tank having on an exterior surface thereof a support member corresponding to and engaging said collecting tank support portion;

whereby said collecting tank and said toner cartridge main body are configured to be installable and removable as a unit from said developing unit.

31. The toner cartridge for an image forming apparatus as in claim 30 wherein said toner cartridge main body is formed integrally by injection molding.

32. The toner cartridge for an image forming apparatus as in claim 30 wherein said collecting tank is formed integrally by blow molding.

33. The toner cartridge for an image forming apparatus as in claim 30 wherein said means for installing said toner cartridge main body into said developing unit of said image forming apparatus comprises a fixing member formed on said toner cartridge main body which conforms to a fixing receiver formed on said developing unit.

34. The toner cartridge for an image forming apparatus as in claim 30 wherein said means for installing said toner cartridge main body into a developing unit of an image forming apparatus further comprises a rotation control part formed on an axial surface of said toner cartridge main body to facilitate rotation of said toner cartridge main body within said developing unit.

35. The toner cartridge for an image forming apparatus as in claim 30 wherein one end of said shaft is formed with a flat surface generally parallel to a central axis of said shaft.

36. The toner cartridge for an image forming apparatus as in claim 30 wherein said developing unit is formed with an end wall having a slot formed therein, an inner portion of said slot defining a shaft retaining portion whereby said flat surface of said shaft is engageable with said shaft retaining portion in response to installation of said toner cartridge main body into said developing unit and rotation of said inner cylindrical member.

37. The toner cartridge for an image forming apparatus as in claim 30 wherein said collecting tank support portion comprises at least one guide portion formed on said cover of said outer cylindrical member.

38. The toner cartridge for an image forming apparatus as in claim 37 wherein said support member on said collecting tank further comprises at least one guide projection configured to engage said guide portion on said cover.

39. The toner cartridge for an image forming apparatus as in claim 38, wherein said guide portion comprises first, second and third guide members, said second and third guide members being composed of a resilient material and which extend from said cover for engaging and holding of said guide projection and said first guide member for limiting movement of said guide projection in a radial direction relative to said toner cartridge main body.

40. The toner cartridge for an image forming apparatus as in claim 30 wherein said collecting tank is configured to be installable and removable from said toner cartridge main body with said toner cartridge main body installed in said developing unit.

* * * * *